US005619842A

United States Patent [19]

Brubaker et al.

[11] Patent Number: 5,619,842

[45] Date of Patent: Apr. 15, 1997

[54] METHOD AND APPARATUS FOR STORING BALED PRE-SILAGE

[76] Inventors: David Brubaker, 1240 W. Fir; Darin Boone, 3834 Dogwood, both of Pasco, Wash. 99301

[21] Appl. No.: 577,491

[22] Filed: Dec. 22, 1995

[51] Int. Cl.[6] ..... B65B 1/20

[52] U.S. Cl. ..... 53/523; 53/527; 53/529; 53/530; 100/179; 100/232

[58] Field of Search ..... 53/526, 527, 529, 53/530, 523; 100/66, 218, 179, 232

[56] References Cited

U.S. PATENT DOCUMENTS

| | | | |
|---|---|---|---|
| 2,969,629 | 1/1961 | Blair | 53/529 |
| 2,974,457 | 3/1961 | Saxton | 53/530 |
| 3,005,403 | 10/1961 | Van Endert | 100/232 |
| 3,638,394 | 2/1972 | Winokur | 53/529 |
| 3,647,095 | 3/1972 | Smith | 100/232 |
| 4,936,206 | 6/1990 | Miles | 100/3 |
| 4,938,006 | 7/1990 | Korsgaard | 53/431 |
| 4,945,715 | 8/1990 | Brodrecht | 53/567 |
| 5,001,974 | 3/1991 | Gombos | 100/4 |
| 5,007,337 | 4/1991 | Newsom | 100/232 |
| 5,088,271 | 2/1992 | Westaway | 53/515 |
| 5,090,177 | 2/1992 | Gombos | 53/399 |
| 5,392,591 | 2/1995 | Simpson | 53/530 |
| 5,408,809 | 4/1995 | Cullen | 53/527 |
| 5,425,221 | 6/1995 | Pronovost | 53/567 |
| 5,433,058 | 7/1995 | Peterson | 53/399 |

*Primary Examiner*—John Sipos
*Assistant Examiner*—Gene L. Kim
*Attorney, Agent, or Firm*—Paul W. Zimmerman

[57] ABSTRACT

The method of the present invention for bagging pre-silage, has the steps of (a) receiving a bale of pre-silage from a loader, (b) compressing the bale in at least one cross section dimension to fit into a bag, and (c) advancing the compressed bale into the bag. The apparatus of the present invention for bagging baled pre-silage, has (a) a support frame having a plurality of lateral walls. The lateral walls define a rear opening to which a bag is attached, and a front opening through which is received the baled pre-silage. At least one of the lateral walls is reversibly movable in a direction toward an opposite lateral wall for compressing or squeezing the baled pre-silage to a size that will fit into the bag. The front opening has a closure and ram for enclosing the baled pre-silage and applying the ram to advnce the compressed baled pre-silage through the rear opening and into the bag. Within the bag, the baled pre-silage is free to expand and completely or nearly completely fill the cross section of the bag.

11 Claims, 6 Drawing Sheets

METHOD AND APPARATUS FOR STORING BALED PRE-SILAGE

FIELD OF THE INVENTION

The present invention relates generally to a method and apparatus for storing baled pre-silage. More specifically, the invention is a method and apparatus for compressing a load of high moisture pre-silage and discharging it into a storage bag.

BACKGROUND OF THE INVENTION

Silage, as known in the art is fermented fibrous material including but not limited to hay, alfalfa or corn. Accordingly the unfermented fibrous material may be referred to as pre-silage. The term hay generally refers to dried fibrous material having a substantially lower moisture content (less than about 15 wt %) than pre-silage. Silage is used as feed for livestock, especially cattle. Because of the high moisture content of the silage (at least about 30 wt %), it is more nutritious than hay. However, the higher moisture content of silage is also more conducive to spoilage.

Accordingly, silage is stored in silo, or more recently in plastic bags. The plastic bags are typically dual walled plastic and are prefolded to expand upon filling. A filled bag is about 100–150 ft. long and about 6–8 ft. in diameter. Heretofore, there have been two methods of placing pre-silage into the bags. One method is to use a loader by simply driving the loader toward the mouth of the bag and placing a bale of pre-silage into the bag. Of course, the first bale will contact the back of the bag and as the loader advances the bale forward, the plastic bag unfolds until the bale is completely surrounded of five sides by the plastic bag. The bale is then set down inside the bag and rests on the ground. This procedure is repeated until the bag is fully extended. A disadvantage of this procedure is that the bales are necessarily smaller than the inside dimensions of the bag. The bales must be smaller than the inside dimensions of the bag so that there is room for the loader to maneuver the bale into the bag. Consequently, there is substantial air space within the bag between the bale and the bag that is detrimental for two reasons; (1) the air combines with the moisture and aerobic bacteria to produce spoilage, and (2) the plastic bag is flaccid permitting wind to whip the loose sides and tear them and lose the integrity of the bag.

Another method of filling the bag is to first chop the pre-silage then put the chopped pre-silage into the bag. The chopped pre-silage fills the bag, reducing air space and producing a tighter bag, but at great expense of labor and equipment to accomplish the chopping.

Hence, there is a need in the silage industry for a method and apparatus for placing pre-silage into a plastic bag in a manner that more completely fills the bag but with less expense and labor of chopping.

SUMMARY OF THE INVENTION

The method of the present invention for bagging pre-silage, has the steps of (a) receiving a bale of pre-silage from a loader, (b) compressing the bale in at least one cross section dimension to fit into a bag, and (c) advancing the compressed bale into the bag.

The apparatus of the present invention for bagging baled pre-silage, has (a) a support frame having a plurality of lateral walls. The lateral walls define a rear opening to which a bag is attached, and a front opening through which is received the baled pre-silage. At least one of the lateral walls is reversibly movable in a direction toward an opposite lateral wall for compressing or squeezing the baled pre-silage to a size that will fit into the bag. The front opening has a closure and ram for enclosing the baled pre-silage and applying the ram to advance the compressed baled pre-silage through the rear opening and into the bag. Within the bag, the baled pre-silage is free to expand and completely or nearly completely fill the cross section of the bag.

It is an object of the present invention to provide a method and apparatus for bagging baled pre-silage.

It is a further object of the present invention to completely or nearly completely fill a bag with baled pre-silage.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DESCRIPTION OF THE PREFERRED EMBODIMENT(S)

According to the present invention, there is provided a method of bagging pre-silage, having generally three steps. The first step is receiving a bale of pre-silage from a loader, wherein the bale has at least one cross section dimension larger than at least one cross section dimension of a bag. After receiving the bale, the next step is compressing the larger cross section(s) of the bale to be smaller than the at least one cross section dimension of the bag. While in the compressed state, the third step is advancing the compressed bale into the bag. Once within the bag, the bale elastically expands therein and substantially fills the volume, especially the cross section, of the bag. In a preferred method, the bale is larger than the cross section of the bag in one dimension by about 5 to 10 percent. The larger cross section is compressed to an amount between about 10 to 25 percent, preferably between about 12 to 15 percent. The bales typically do not fully expand back to their original dimension.

Because the bags, as manufactured, have a circular cross section, the inherent cross section of the bag is a diameter. However, in a preferred method, at least one cross section dimension of said bag is a horizontal width. A horizontal width is accomplished by placing the bag on a bag holding rack that has a rectangular or square opening, thereby causing the opening of the bag to be square or rectangular, leaving extended portion of the bag to conform to the shape of inserted pre-silage. It is further preferred that the compressing of the bale is done in a horizontal direction.

Whether the bale is cylindrical or rectangular, it is preferred that the bale is compressed by squeezing the bale between two vertical walls oriented substantially in parallel with sides of the bag. This orientation facilitates pushing the bale and sliding the bale in a direction substantially parallel with the sides of the bag past the vertical walls into the bag.

Figure 1:
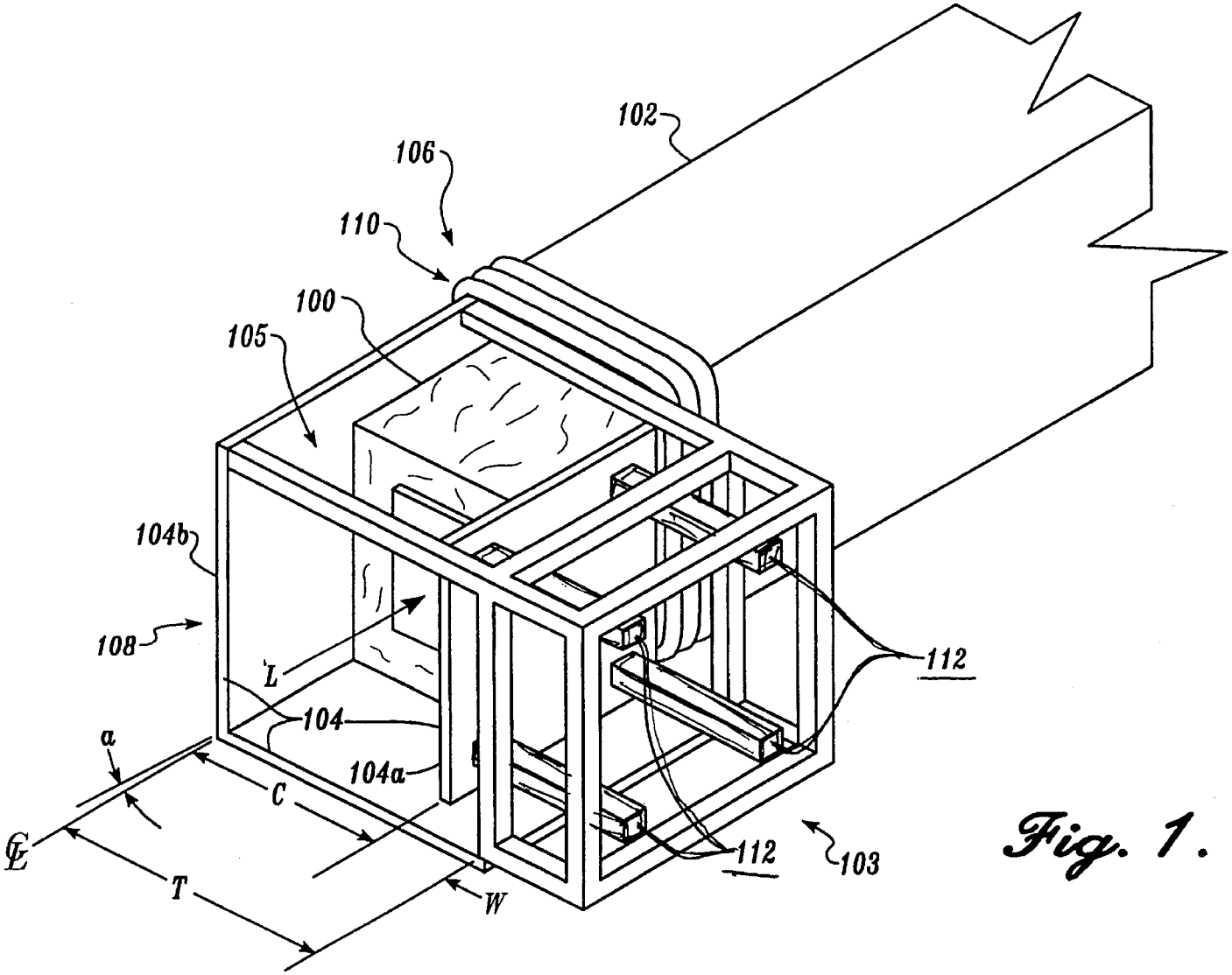
FIG. 1 is a simplified isometric of the apparatus with straight lateral sides.

Referring now to FIG. 1, an embodiment of the present invention is shown. The apparatus of FIG. 1 is for the purpose of packing baled pre-silage 100 into a bag 102. The apparatus has a support frame 103 having a plurality of lateral walls 104 surrounding a space 105 for receiving the baled pre-silage 100. The support frame 103 further defines a rear opening 106 and front opening 108. At the rear opening 106 the bag 102 is attached with a receiving opening 110 of the bag 102 supported and held open on the rear opening 106. The rear opening may include a bag holding rack (not shown). Alternatively, a bag holding rack may be integral to the rear opening. It is not necessary that the support frame 103 be in exact alignment with the extended portion of the bag 102. In fact, due to various details of construction, including but not limited to rollers or wheels, the frame 103 may have a slight upward tilt indicated by angle a from the ground level GL. In fact, a slight upward tilt is beneficial to a loader operator inserting the baled pre-silage 100.

In operation, the baled pre-silage 100 is passed through the front opening 108 into the space 105 in the longitudinal direction L. The received baled pre-silage 100 has at least one transverse dimension T that is larger than at least one corresponding dimension C of the rear opening 106. At least one of the lateral walls 104, for example 104*a*, is reversibly movable in a direction toward an opposite lateral wall 104, for example 104*b*, for reducing the larger transverse dimension T of the baled pre-silage to a size smaller than the corresponding dimension C of the rear opening 106.

It will be apparent to those skilled in the art of hay compression that many modifications may be made to the shape of the support frame 103 including a top lateral wall 104 (not shown) without departing from the invention. For example the lateral walls 104 may be solid or perforated. If perforated, it is preferred that the perforations do not permit pre-silage to extrude through the perforations as the pre-silage is advanced into the bag. This extrusion may be prevented with horizontally oriented perforations. Smooth bars may be used in parallel in a horizontal orientation. Nevertheless, solid lateral walls 104 are preferred to minimize loss of pre-silage during bag packing. The solid lateral walls 104 may be reinforcements in the form of ribs or convolutions or corrugations for structural support. If the reinforcements affect the shape of the inner surface in contact with the baled pre-silage 100, it is preferred that the reinforcements have a horizontal orientation to facilitate advancement of the baled pre-silage 100 into the bag 102.

Additionally, while it is preferred that the pre-silage be baled, the shape of the bale is not critical. Large rectangular bales or several smaller rectangular bales may be used, or cylindrical bales may be used. Further, lateral walls 104 may be made circular as shown in FIG. 2 if it is desired to maintain a cylindrical shape of cylindrical bales during compression.

It will be apparent to those skilled in the art of compressing pre-silage, that the movable wall, for example 104*a*, may be moved by any moving mechanism 112 including but not limited to powered screw, or hydraulic cylinder. Further, it will be apparent that one or more moving mechanisms 112 may be employed to move the movable wall. In a preferred embodiment, linear actuators are used, most preferably hydraulic cylinders are used, on cylinder at each corner of the moveable wall.

Figure 3A:
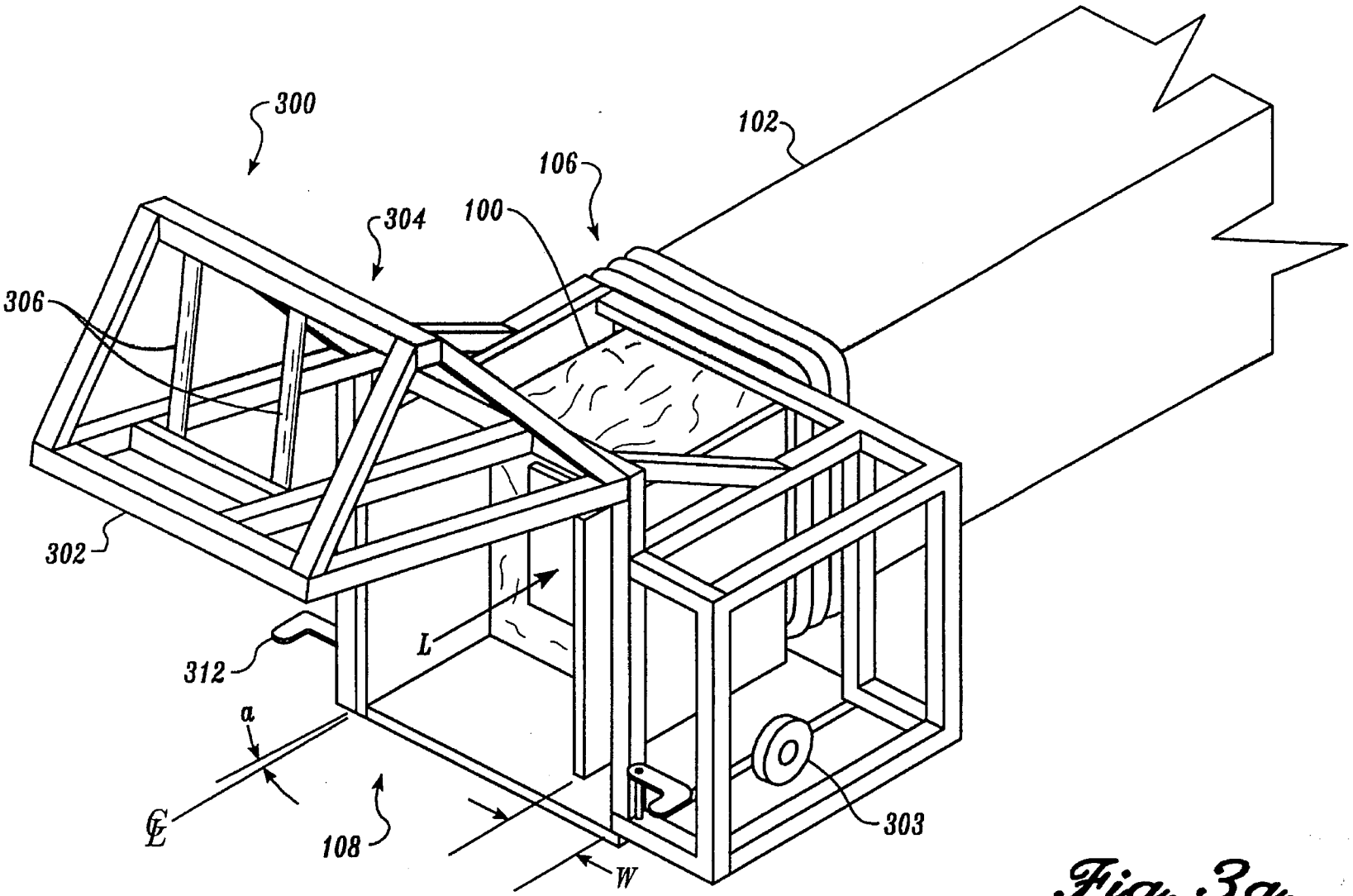
FIG. 3*a* is an isometric of the apparatus including the closure in an open position.
Figure 3B:
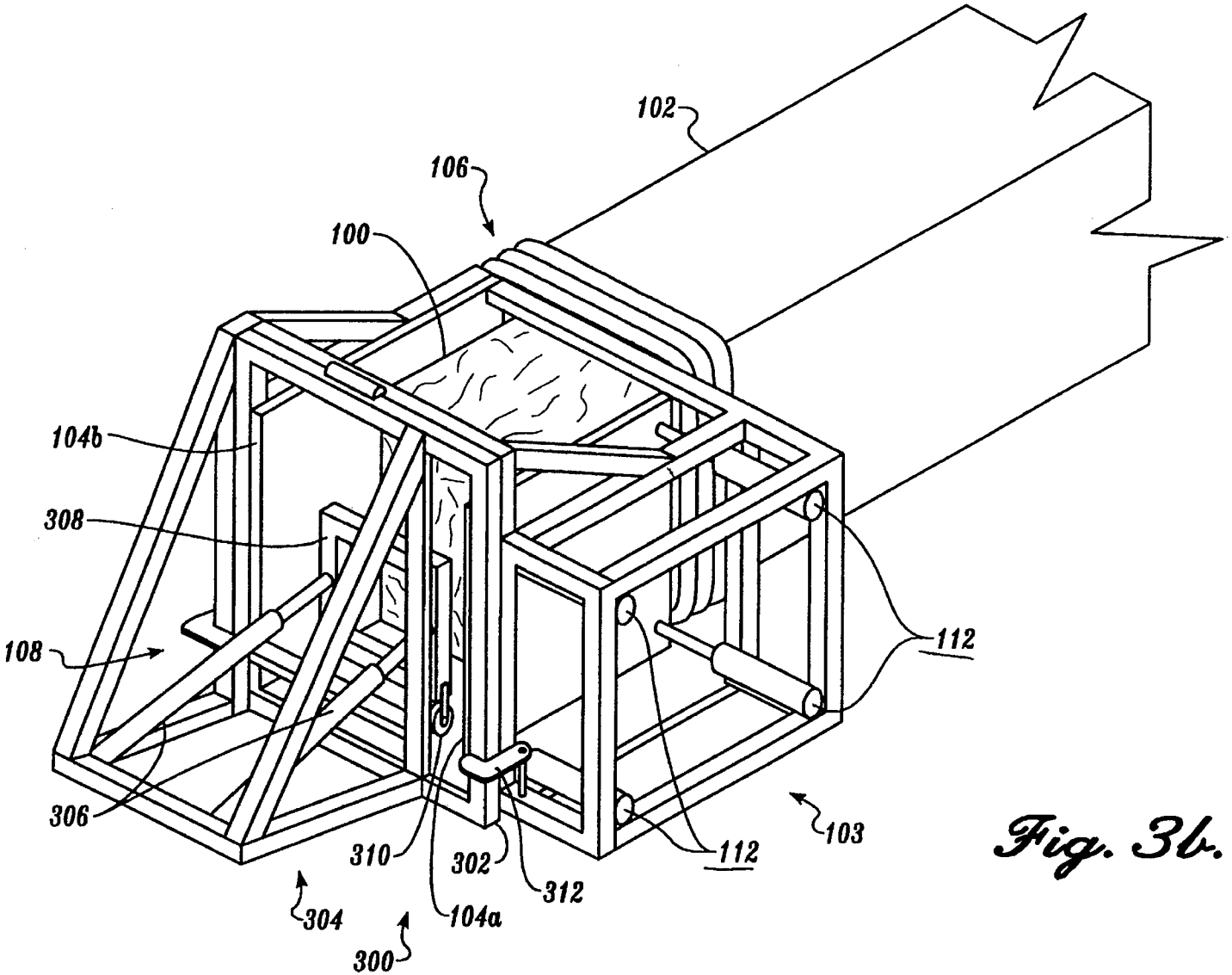
FIG. 3*b* is an isometric of the apparatus including the closure in a closed position.

Referring now to FIG. 3*a* and FIG. 3*b*, there is shown on the front opening 108 a closure 300 for enclosing the baled pre-silage and a ram 308 to advance the compressed baled pre-silage 100 through the rear opening 106 and into the bag 102. Once the baled pre-silage 100 is beyond the lateral walls 104*a*, 104*b* the reduced dimension is free to expand within the bag.

Figure 2:
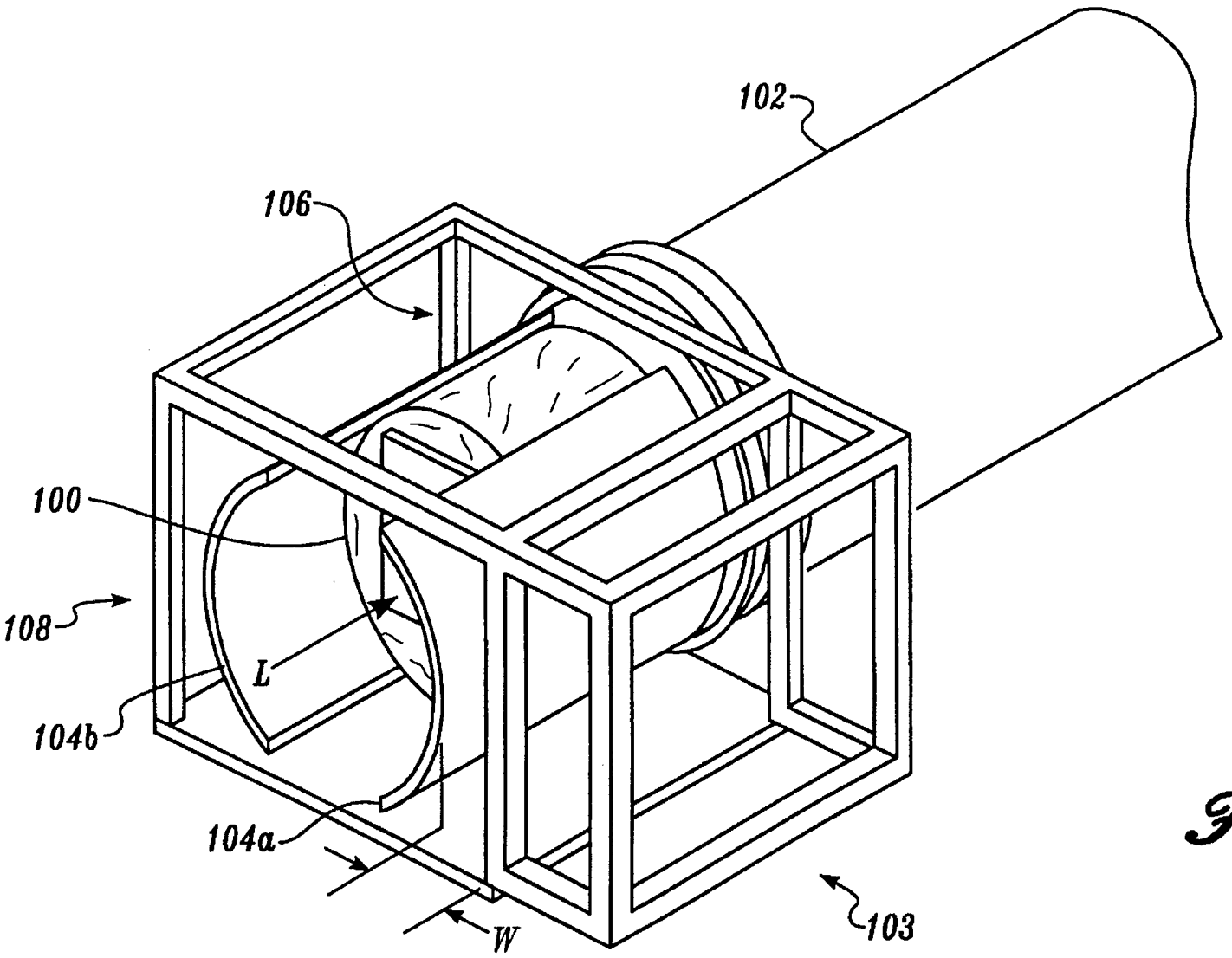
FIG. 2 is a simplified isometric of the apparatus with curved lateral sides.

It will be noted that in FIG. 3*a* and FIG. 3*b*, the front opening 108 is larger than in FIG. 1 or FIG. 2. A larger opening may be preferred to facilitate placing the baled presilage 100 into the apparatus. The closure 300 may be solid or open, but is preferred to be an open frame as shown. The closure 300 includes a face frame 302 that contacts the support frame 103 about the front opening 108. The face frame 302 is preferably hinged to the support frame 103 and most preferably hinged at the top. By hinging at the top, the closure 300 is out of the way upon loading baled pre-silage 100 and bags 102 may be placed close together. The hinging shown in FIG. 3*a* and FIG. 3*b* is a rotational hinging. It is also contemplated that translational attachment may be used to horizontally or vertically slide the closure 300 from open to closed positions and vice versa. Also included in FIG. 3*a* are wheels 303. The wheels are used to move the apparatus and to facilitate its forward motion as baled pre-silage 100 is advanced into the bag 102.

The closure 300 further includes a pusher reaction frame 304 attached to the face frame 302. At least one pusher 306 is mounted within the closure 300. The pusher 306 may be any type of mechanical pusher including but not limited to linear actuators, for example mechanical screw or a piston and cylinder. It is preferred that the pusher is a hydraulic cylinder. The pusher(s) 306 is/are connected to the ram 308 that contacts the baled pre-silage 100. The ram 308 may be solid or open and of any shape. It is necessary, however, that the ram 308 (FIG. 3*b*) be of a size and shape to advance the baled pre-silage 100 under lateral compression through the rear opening 106. In order to minimize lateral loading on the pusher(s) 306, rollers 310 may be placed on the ram 308 that roll on the bottom lateral wall 104.

Latches 312 are used to hold the face frame 302 of the closure 300 to prevent the closure 300 from opening when the ram 308 is pushing the baled pre-silage 100. The latch may be of any type, but the rotary side latch 312 is preferred. It will be apparent to one skilled in the art of latches that a latch may be positioned on the bottom or may be translational rather than rotary. The type of latch is not critical to the present invention. The latch may be actuated with any linear actuator, for example a solenoid, mechanical screw, or piston and cylinder. It is preferred to use a hydraulic cylinder so that all mechanical motion is controlled with a common motive source.

Figure 5:
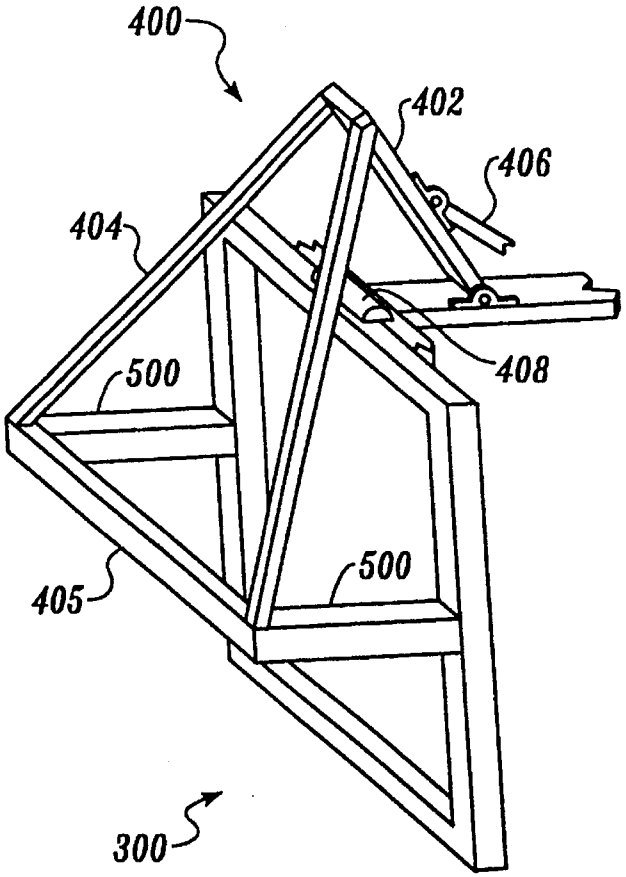
FIG. 5 is isometric view of an alternative embodiment of the closure including the opener.
Figure 4:
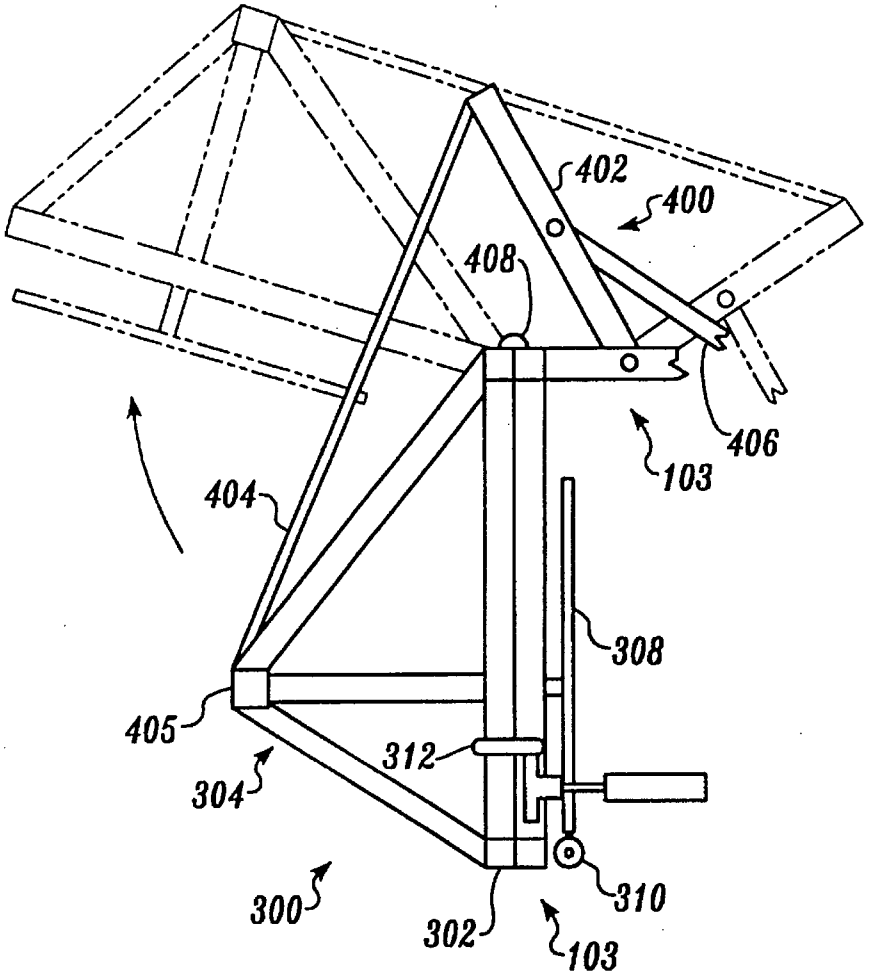
FIG. 4 is a side view of the closure including the opener.

In order to open and close the closure 300, it is necessary to do so with a mechanism that does not interfere with placing the baled pre-silage 100 through the front opening 108. Accordingly, in FIG. 4 and FIG. 5 is shown a preferred embodiment of an opener 400. The opener 400 has a pivoting strut 402 attached to at least one connected strut 404 that is attached to the reaction bar 405. An actuator 406 is attached to the pivoting strut 402. The actuator 406 is also pivoted and may be any type of linear actuator, but is preferably a hydraulic cylinder. The closure 300 is attached to the support frame 103 with a hinge 408. The hinge 408 may be any mechanical hinge.

Also shown in FIG. 5 is an alternative arrangement for the closure 300. In this embodiment, the reaction bar 405 is supported by horizontal members 500.

Figure 6:
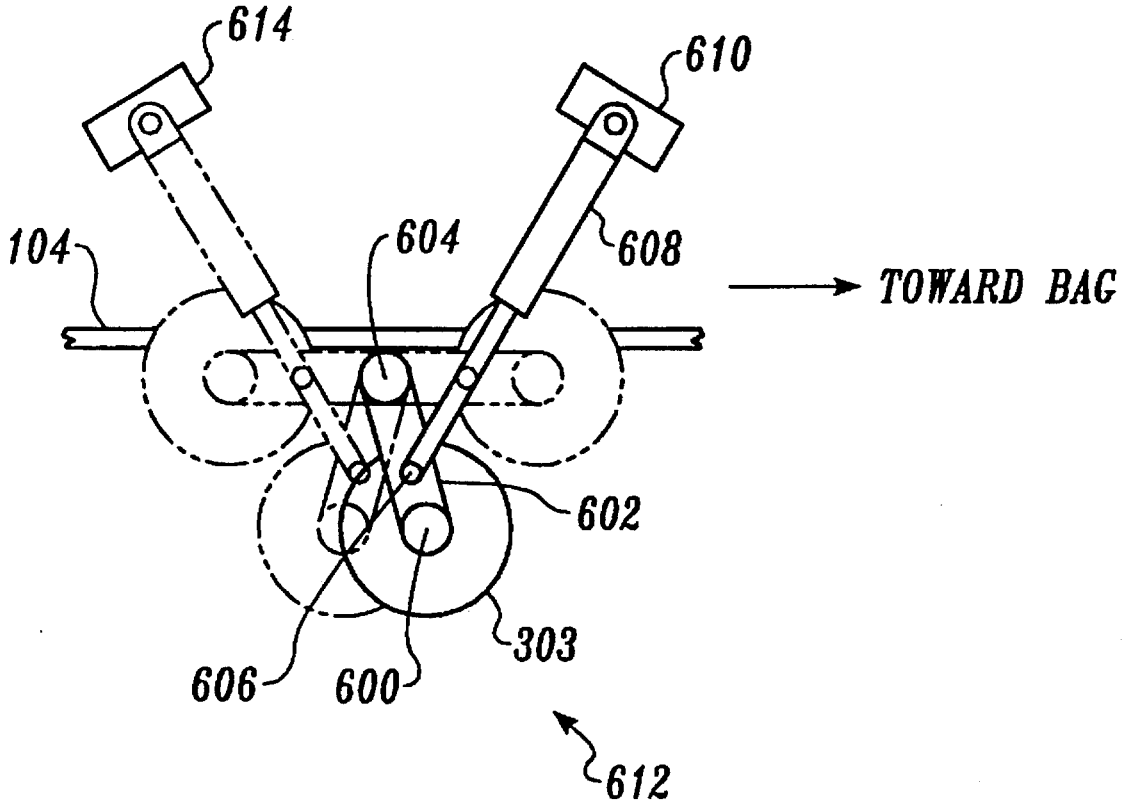
FIG. 6 is a side view of the wheel positioning mechanism.

The wheels 303 are mounted so that they may be moved and permit the apparatus to rest on the ground. A preferred embodiment for wheel mounting is shown in FIG. 6. The wheels 303 are mounted on axles 600 that are attached to crank arms 602. The crank arms 602 are further attached to a support rod 604. The support rod 602 preferably extends across the width of the support frame 103. One of the crank arms 602 has a pivot 606 located between the axle 600 and the support rod 604. A linear actuator 608 is attached to the pivot 606. Because the support rod 602 extends across the width of the support frame 103, wheels 303 on both sides of the support frame 103 may be actuated by a single linear actuator 608. To transport the apparatus, the linear actuator 608 is connected to a first actuator block 610 and the wheel 303 is placed in a travel position 612. To permit the portion of the support frame 103 connected to the bag 102 to rest near or on the ground while baled pre-silage 100 is loaded into the bag 102, the linear actuator 608 is disconnected from the first actuator block 610 and reconnected to the second actuator block 614. With the linear actuator 608 connected to the second actuator block 614, the wheel 303 may be raised or lowered to increase or decrease ground contact of the support frame 103.

It will be apparent to one skilled in the art of mechanical actuation that cables or chains wound on drums may be used to effect the necessary motion of various elements of the apparatus. However, it is preferred to use actuators that require positive displacement both for pushing and pulling be used for safe reliable operation.

EXAMPLE 1

An apparatus was constructed according to the present invention and operated according to the method of the present invention. In operation, it was determined that use of the method and apparatus of the present invention permits filling the bag 102 with at least from about 10 vol % to about 15 vol % more than is achievable without compressing the baled pre-silage 100. Moreover, the bag 102 is filled about 2 to 3 times faster compared to present methods. Accordingly, the present invention represents an unexpected improvement in the art of bagging baled pre-silage 100. With this particular apparatus, bales received were approximately 6 ft high which would fit into the bag 102, and about 7 ft wide which would not fit until compressed. The lateral compression was about 14 inches to about 18 inches, or about 20%. After entering the bag 102, the bale expanded partially.

The hydraulic system of the constructed apparatus was manually controlled. The bag holding rack was obtained from Noffsinger and attached to the rear opening 106.

CLOSURE

While a preferred embodiment of the present invention has been shown in described, it will be apparent to those skilled in the art that many changes and modifications may be made without departing from the invention in its broader aspects. Specifically automated controls may be incorporated permitting operation of the apparatus from within a tractor cab so that one person may drive the tractor and operate the apparatus to fill the bag without leaving the cab of the tractor.

The appended claims are therefore intended to cover all such changes and modifications as fall within the true spirit and scope of the invention.

We claim:

1. An apparatus for bagging pre-silage, comprising:

(a) a support frame having a plurality of lateral walls surrounding a space for receiving said baled pre-silage, said support frame further defining (i) a rear opening to which a bag is attached with a receiving opening of said bag supported and held open on said rear opening; and (ii) a front opening through which is received the baled pre-silage, said received baled pre-silage having at least one transverse dimension larger than at least one corresponding dimension of said rear opening;

(b) at least one of said lateral walls reversibly movable in a direction toward an opposite lateral wall for reducing the larger transverse dimension of the baled pre-silage to a size smaller than the corresponding dimension of the rear opening;

(c) said front opening having a closure moveably attached to said front opening and a ram mounted on said closure for enclosing the baled pre-silage and applying the ram to the reduced dimension baled pre-silage and advancing the reduced dimension baled pre-silage through said rear opening and into said bag, wherein the baled pre-silage is beyond said lateral walls and the reduced dimension is free to expand within the bag.

2. The apparatus as recited in claim 1, wherein said closure is actuated by an opener.

3. The apparatus as recited in claim 1, wherein said reversibly moveable wall is actuated by at least one linear actuator.

4. The apparatus as recited in claim 1, wherein said closure is connected to a linear actuator.

5. The apparatus as recited in claim 1, wherein said ram is actuated by at least one linear actuator.

6. The apparatus as recited in claim 1 wherein said closure has a face frame that is hinged to the support frame defining the front opening.

7. The apparatus as recited in claim 6, further comprising a latch that holds the face frame against the support frame defining the front opening.

8. The apparatus as recited in claim 1, further comprising wheels supported beneath a bottom lateral wall permitting longitudinal motion of the apparatus.

9. The apparatus as recited in claim 8, wherein said wheels are support on axles that are connected to crank arms which are connected to a support rod extending across a width of the bottom lateral wall.

10. The apparatus as recited in claim 9 wherein said wheels are positionable with a linear actuator connected to said crank arm.

11. The apparatus as recited in claim 1, wherein elements that move the respect to each other are moved with hydraulic cylinders.

* * * * *